US006892636B2

(12) United States Patent
Bachmeir

(10) Patent No.: US 6,892,636 B2
(45) Date of Patent: May 17, 2005

(54) POSITIONING DEVICE FOR FUNCTIONAL DEVICES OF PRINTING PRESSES

(75) Inventor: Xaver Bachmeir, Affing-Haunswies (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/723,652

(22) Filed: Nov. 24, 2003

(65) Prior Publication Data

US 2004/0103807 A1 Jun. 3, 2004

(30) Foreign Application Priority Data

Nov. 29, 2002 (DE) ..... 102 55 807

(51) Int. Cl.[7] ..... B41F 13/14

(52) U.S. Cl. ..... 101/248; 101/425; 101/480; 101/484

(58) Field of Search ..... 101/248, 480, 101/425, 481, 423, 479, 484, 485, 478

(56) References Cited

U.S. PATENT DOCUMENTS 5,109,768 A * 5/1992 Lubke et al. ..... 101/153
6,397,743 B1 * 6/2002 Dauer et al. ..... 101/220
6,502,509 B2 * 1/2003 Gottling et al. ..... 101/248
2001/0035104 A1 11/2001 Gottling et al.

* cited by examiner

*Primary Examiner*—Andrew H. Hirshfeld
*Assistant Examiner*—Kevin D. Williams
(74) *Attorney, Agent, or Firm*—Cohen, Pontani, Lieberman & Pavane

(57) ABSTRACT

A positioning device for functional devices of printing presses, having at least one guide unit and one drive for moving and positioning the functional device for throwing-on/throwing-off movements with regard to impression cylinders. Weight compensation means are provided for the vertical displacement, so that the drive can be at least partially relieved of the weight of the functional device.

8 Claims, 2 Drawing Sheets

POSITIONING DEVICE FOR FUNCTIONAL DEVICES OF PRINTING PRESSES

BACKGROUND OF THE INVENTION

1. Field of the Invention

The invention relates to a positioning device for functional devices of printing presses having at least one guide unit and at least one drive for positioning a functional device for throwing on and throwing off movements with respect to impression cylinders.

2. Description of the Related Art

A printing unit for rotary presses is known from U.S. Pat. No. 6,502,509, in which printing unit it is possible to move functional devices relative to the printing-unit side wall by means of cross-slides and to position them relative to other printing-unit devices. Inking units, damping units or washing apparatuses, for example, can be aligned with various cylinders with respect to their vertical position by positioning devices of this type, thrown on and off, and also moved entirely out of the region of a printing-unit cylinder. Furthermore, in the case of this printing unit, the printing-unit cylinders can also be moved relative to the printing-unit side wall.

SUMMARY OF THE INVENTION

The object of the invention is to create a compactly constructed drive for a positioning device of this type.

According to the invention, a weight compensation device is provided for relieving the drive of the weight of the functional device as it is displaced vertically.

It is advantageously possible to use small drive motors for the vertical displacement as a result of the weight compensation according to the invention.

Using a positioning device configured according to the invention, it is advantageously possible to pick up inking-unit modules or damping-unit modules as a unit and position them in a controlled manner along the displacement paths of the device. It is advantageously possible to move to the on or off position of the inking unit, operating or maintenance positions. Furthermore, it is advantageously possible to move the inking unit or another functional device into any positions desired, in order to vacate movement spaces for other components. It is possible, for example, to create free space at the impression cylinders for image-setting devices, fixing devices or washing apparatuses.

Using the positioning device according to the invention, it is also advantageously possible to move to the different inking positions of various forme cylinder diameters.

Using a positioning device according to the invention, it is possible to move an inking or damping unit so as to follow a forme cylinder in the different operating states, such as pre-inking or printing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
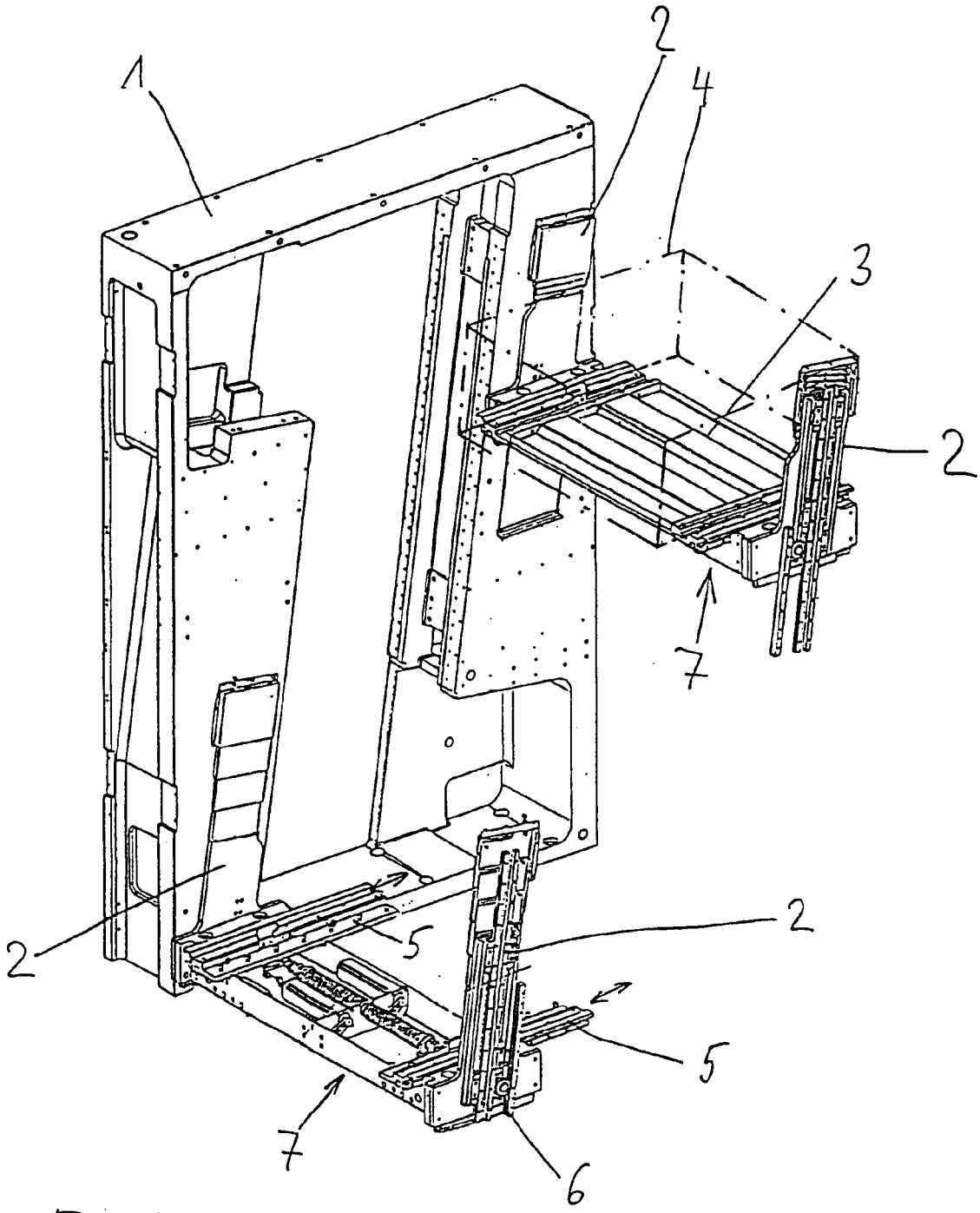
FIG. 1 is a perspective view of a part of a printing unit having a positioning device according to the invention.

The printing unit, shown in FIG. 1, of a printing press corresponds substantially to the printing unit as known from U.S. Pat. No. 6,502,509, which is hereby incorporated by reference, and likewise comprises at least one forme and impression cylinder which can be positioned and moved with respect to their mutual spacing. Furthermore, functional devices are also provided, such as an inking/damping unit, for inking purposes, and preferably also devices for image-setting, fixing the forme, removing images and washing.

Since these devices are known, for the sake of greater clarity they have not been illustrated. Only one side wall 1 is shown of the depicted printing unit, on which side wall 1 guides 2 are arranged for guiding the positioning devices 7. On the positioning device 7 shown at the top, a holding plate 3 is provided, in which it is possible to accommodate a functional device 4. The functional device 4 is shown schematically in dash-dotted form and is, for example, an inking-unit or damping-unit module which can be added or removed as a complete part.

The guides 2 can be arranged vertically or else in an inclined manner, guide the positioning device substantially in the vertical direction, and take up the weight of the functional device 4.

Guide rails 5 are provided for the horizontal displacement movement, as can be seen from the positioning device 7 shown at the bottom. The holding plate 3, which can be fastened to the guide rails 5, is removed at this positioning device 7. Using the guide rails 5, it is possible to throw the functional device 4 onto or off the printing-unit cylinders (not shown) in the direction of the arrow.

The core of the invention is providing weight compensation for the weight of the functional device, so that it is possible to position and move even relatively heavy functional devices, such as inking units with a mass of over 500 kilogrammes, using a drive which is compactly constructed according to the invention. It is possible to lessen the load on the drive motor for the vertical displacement, and therefore design it to be substantially smaller, as a result of this weight compensation according to the invention.

Figure 2:
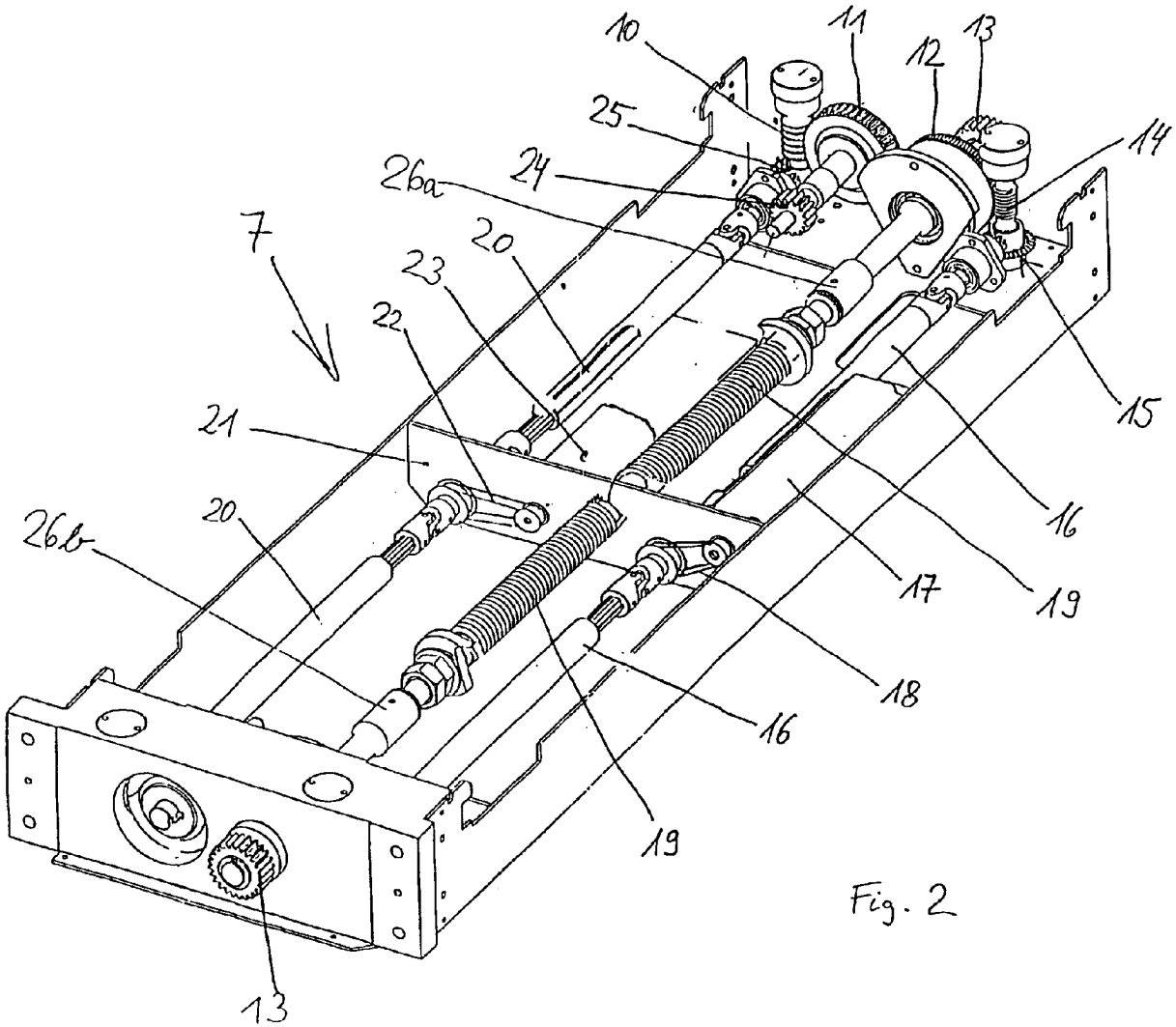
FIG. 2 is a perspective view of an embodiment of a positioning device according to the invention.

The drive elements of an exemplary embodiment of the positioning device 7 can be seen from FIG. 2.

For the horizontal displacement, a first motor 23 is provided, which drives a shaft 20 via a belt drive 22. This shaft 22 extends over the width of the positioning device 7 and drives a pinion 24 on both sides. These pinions 24 in each case interact with the guide rails 5 (FIG. 1), which are provided with a rack (not shown) for this purpose. The guide rails 5 are preferably guided using conventional linear guides, which are fastened to the positioning device 7.

In order to drive the rack pinions 24, it is possible to provide a mechanism at both ends of the shaft 20. For this purpose, an angle drive, preferably a bevel gear drive 25, is provided at each end of the shaft 20, the drive driving a preferably self-locking worm 10. The worm 10 interacts with a worm gear 11, which is arranged on a common shaft with the pinion 24. It is possible to provide a slipping clutch, which triggers in the event of excess loads, in the drive connection between the worm gear 11 and the pinion 24.

The drive elements shown at one end of the positioning device 7 are also present at the other end, where they are merely hidden by the housing. This also holds true for the drive elements of the vertical displacement means, where mechanisms are likewise preferably provided on both sides.

A motor 17, which drives a first shaft 16 via a belt drive 18, is an element of the vertical drive. The shaft 16 extends over the width of the positioning device 7 and drives a pinion 13 on both sides. These pinions 13 interact in each case with the racks 6 (FIG. 1) which are arranged on the guides 2 (FIG. 1).

A mechanism is preferably provided at both ends of the shaft 16 to drive the pinions 13. For this purpose, an angle drive, preferably a bevel gear drive 15, is provided at each end of the shaft 16, the drive driving a preferably self-locking worm 14. The worm 14 interacts with a worm gear 12, which is arranged on a common shaft 26*a* or 26*b* with the pinion 13. The pinions 13 project laterally out of the housing of the positioning device 7 and the shaft 26 extends within the housing from one pinion to the other pinion 13, the shaft 26 preferably being subdivided into two sections 26*a* and 26*b* in the region of a holding device 21. These sections can be rotated counter to one another. Springs 19, for example helical springs, are arranged on the shaft sections 26*a* and 26*b* and their one end is in each case hooked into the shaft section 26*a* or 26*b* and their other end is in each case hooked into the holding device 21. When the shafts 26 rotate during the downward movement of the positioning device 7, the springs 19 are twisted counter to their permanent clamping on the holding device 21 and thus stressed. During the upward movement of the positioning device 7, the springs 19 are relieved of stress and the energy which is released in the process is converted into potential energy via the pinions 13 in conjunction with the rack 6 (FIG. 1). The load on the motor 17 is lessened by the spring force during the lifting of the positioning device 7 with the functional device, as a result of which the motor 17 can be of substantially smaller dimensions. At the highest position of the positioning device 7, the springs 19 can additionally be provided with a prestress.

Slipping clutches which release the drive connection in the event of overloading can be provided in the drive connection between the worm gears 12 and the pinions 13. These slipping clutches are preferably arranged on the worm gear 12 and can also be actuated to decouple the drive connection to the shaft 26. For this purpose, it is possible to use, for example, electromagnetically operating slipping clutches. This embodiment or arrangement of the slipping clutch can also be provided for the horizontal displacement means of the positioning device 7.

By virtue of step-down gear mechanisms being arranged on both sides, the shafts 16, 20 are exposed to a comparatively small torque and can be of correspondingly small dimensions. Articulated pieces and/or sliding pieces can be provided on the shafts 16, 20 in order to compensate for longitudinal and/or axial offset.

As a result of the self-locking action of the worms 10, 14, it is possible to switch off the current supply to the motors 17, 23 after the position is reached, and the motors 17, 23 are thus not subjected to a load.

Respective appropriate distance measuring systems (familiar to the person skilled in the art) are provided on the guides 2, 5 for locationally accurate positioning and are coupled to the control unit of the positioning device. Furthermore, it is possible to provide force and/or distance sensors, which record, for example, the distance to other devices or maximum permissible forces. It is thus possible to avoid collisions or damage by appropriately actuating the drives.

It is possible to synchronize the displacement movements of the positioning device 7 electronically with linear movements performed by the impression cylinders with regard to the side wall. Furthermore, it is possible to provide a releasable mechanical coupling between the positioning device 7 and the displacement device for the impression cylinders, so that the height of the functional device is adjusted by means of the impression cylinders. It is possible here to disengage the slipping clutches in a controlled manner, so that the shaft 26 can be rotated with respect to the worm gears 12 and the weight compensation is still active as a result of the spring force.

As an alternative to the described embodiment with a gear wheel/rack, it is also possible, for example, to implement the displacement movement of the positioning device 7 by means of a spindle/nut arrangement (known to the person skilled in the art).

The weight compensation for the positioning device 7 or the functional device can also be performed using compression, tension or leaf springs, which are fastened at one end to the positioning device 7 and at the other end to the printing-unit side wall 1 (FIG. 1).

Furthermore, it is also conceivable to provide counterweights, which are connected to the positioning device 7, for example, via control cables and deflection rollers and move up and down, for example, in cavities in the printing-unit side wall 1 (FIG. 1).

For weight compensation purposes, it is also possible to arrange pneumatic cylinders, hydraulic cylinders or gas-pressure springs parallel to the guides 2 (FIG. 1), on which cylinders or springs it is possible for the positioning device 7 to be supported with respect to the side wall 1 (FIG. 1).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A positioning apparatus for functional devices in a printing press having impression cylinders mounted to at least one side wall, said apparatus comprising:

at least one guide unit for guiding a functional device substantially vertically;

a vertical drive for displacing the functional device substantially vertically, said drive comprising a shaft;

at least one helical spring for at least partially relieving the vertical drive of the weight of the functional device as the functional device is displaced substantially vertically, each said helical spring having an end which is fixed and an end which is rotatable with said shaft;

at least one guide unit for guiding the functional device substantially horizontally; and a horizontal drive for displacing the functional apparatus substantially horizontally.

2. A positioning apparatus as in claim 1 wherein said drive comprises one of a rack/pinion and a spindle/nut.

3. A positioning apparatus as in claim 1 comprising two said guide units for each of said vertical and horizontal displacements, said drives each comprising a common shaft which extends to two mechanism arrangements, each mechanism arrangement engaging a respective said guide unit.

4. A positioning apparatus as in claim 1 further comprising:

means for moving the impression cylinders linearly with respect to the plane of said side wall; and means for electronically synchronizing the positioning apparatus with the linear movement of the impression cylinders.

5. A positioning apparatus as in claim 1 further comprising sensors on the positioning apparatus for recording at least one of the drive force and the distance to other positioning apparatus; and means for limiting the drive force in response to signals from said sensors.

6. A positioning apparatus as in claim 2 further comprising a slipping clutch provided at one of said pinion and said spindle/nut for limiting the drive force.

7. A positioning apparatus as in claim 1 wherein said guide unit for guiding said functional device vertically comprises a rack arranged on the side wall;

said shaft is a pinion shaft;

said vertical drive further comprises an electric motor, a first shaft driven by said motor via a belt drive, a worm driven by said first shaft via a bevel gear, a worm gear fixed to said pinion shaft and driven by said worm, and a pinion fixed to said pinion shaft and interacting with said rack; and said at least one helical spring being prestressed during downward displacement of said functional device and being unstressed to form potential energy during upward displacement of said functional device.

8. A positioning apparatus as in claim 1 wherein said at least one helical spring is fitted around said shaft.

* * * * *